United States Patent [19]

Teodorescu et al.

[11] 4,018,554

[45] Apr. 19, 1977

[54] METHOD OF AND APPARATUS FOR THE COMBUSTION OF LIQUID FUELS

[75] Inventors: Constantin Teodorescu; Corneliu Vlădut Costache, both of Bucharest, Romania

[73] Assignee: Institutul Pentru Creatie Stintifica si Tehnica-Increst, Bucharest, Romania

[22] Filed: Jan. 14, 1976

[21] Appl. No.: 648,872

[30] Foreign Application Priority Data

Mar. 19, 1975 Romania ..... 81712

[52] U.S. Cl. ..... 431/9; 239/406; 239/424; 239/427.3; 239/432; 431/183; 431/188; 431/354

[51] Int. Cl.[2] ..... B05B 7/04; B05B 7/10; F23D 7/00

[58] Field of Search ..... 431/8, 9, 10, 181, 183, 431/187, 188, 354; 60/39.74 R, 39.71; 239/423, 424, 432, 403, 405, 406, 427.3

[56] References Cited

UNITED STATES PATENTS

| | | | |
|---|---|---|---|
| 2,138,998 | 12/1938 | Brosius | 431/8 |
| 3,570,242 | 3/1971 | Leonardi et al. | 431/354 X |
| 3,691,765 | 9/1972 | Carlisle | 60/39.74 B |
| 3,729,285 | 4/1973 | Schwedersky | 431/8 |
| 3,730,668 | 5/1973 | Iida | 431/10 |
| 3,739,576 | 6/1973 | Chamberlain | 60/39.74 R |
| 3,739,989 | 6/1973 | Vosper | 239/427.3 |
| 3,787,169 | 1/1974 | Gjerde | 431/354 X |
| 3,832,121 | 8/1974 | Metz et al. | 431/8 |
| 3,869,865 | 3/1975 | Lacroix et al. | 60/39.74 R |
| 3,880,571 | 4/1975 | Koppang et al. | 431/8 |

*Primary Examiner*—C. J. Husar
*Assistant Examiner*—Leonard Smith
*Attorney, Agent, or Firm*—Karl F. Ross; Herbert Dubno

[57] ABSTRACT

A method and an apparatus for the combustion of high viscosity low grade liquid fuel (e.g., residual oil), in which the fuel is directed through an ejector into an impact chamber in which it impinges upon a baffle with the rebounding fuel particles being further pulverized by jets of air introduced into this chamber with an inclination to the axis of the burner. The resulting fuel-air mixture passes around the impingement baffle with a laminar flow of air passing axially along the wall of this chamber and preventing precipitation of fuel droplets thereon. Upon emergence from the chamber the fuel-air mixture encounters a flow of air passing along the exterior of the impact chamber and intercepted by a plurality of inwardly extending steps which further-promote pulverization and mixing. Beyond these steps the mixture flows into an expansion chamber following which it impinges upon a further baffle before emerging from the expansion chamber to encounter a rotated stream of air passing along the exterior of the expansion chamber. A further outwardly directed annular flow of air externally of the rotated flow deflects the mixture outwardly.

10 Claims, 4 Drawing Figures

METHOD OF AND APPARATUS FOR THE COMBUSTION OF LIQUID FUELS

FIELD OF THE INVENTION

The present invention relates to a method of and to a burner for liquid fuels such as black oils and tars of high viscosity.

BACKGROUND OF THE INVENTION

There are methods and burners for burning the black oils wherein the pulverization of the fuel is effected by means of steam or compressed air. Burners utilizing pulverization by means of low-pressure air at 250 kgf/m² (kilogram-force per square meter) are used for black oils with up to 300 kg/h (kilograms per hour) average flow rate. These burners may be of the vortex type, the vortex motion being produced by means of the tangential introduction of the air into the burner housing or by guide blades.

The main disadvantage of pulverization by steam or compressed air is the high cost of the pulverization agent and the need for sources of steam or compressed air which often must be of large capacities.

There are also methods and burners in which the pulverization of the fuel is performed at high pressures with moderate and small flow rates requiring nozzles with a very small diameter.

The disadvantage of the latter systems is that small nozzles clog very easily and produce abnormal fine pulverization and flames.

Another burner with liquid fuel is known in which the pulverization is carried out in two stages at low pressure. In the first stage pulverization is performed by the air which enters through a plurality of apertures in a profiled body; this body may be axially moved thus decreasing, at lower levels of operation, the flow cross section through which the air passes for the second stage of pulverization.

This type of burner also has the disadvantage of an abnormal pulverization of the fuel and of nozzle clogging.

OBJECT OF THE INVENTION

It is the object of the present invention to provide an improved burner for high-viscosity liquid fuels, and a method of operating such a burner, whereby the aforementioned disadvantages can be avoided.

SUMMARY OF THE INVENTION

The method, according to the invention, eliminates the above mentioned disadvantages by using a sequence of pulverization stages. In the first stage the pulverization of the fuel introduced under pressure through a channel is carried out by impact or shock against a profiled baffle in association with pulverization by annular incident jets within an air film, which "washes" (i.e., flows along) the walls of an impact chamber. The second pulverization stage combines an initial pulverization by shock due to the impact of the air-fuel jets against the elements of a rosette-shaped obstacle body with a pulverization which is due to an annular peripherical air jet successively deflected by two steps which are located in a mixing chamber and which determine the interaction by incidence and vorticity of the two jets, thus increasing the high quality of the pulverization.

The new mixture leaves the mixing chamber through a narrow outlet and enters an expansion chamber with a larger diameter.

At the end of this chamber the final stage of pulverization by shock takes place with the aid of a rosette-shaped obstacle with peripherical apertures, followed by another pulverization due to the interaction between the air-fuel jet and a peripherical annular air jet with a helicoidal movement produced by a fixed helicoidal surface with inclined blades which produces at the discharge of the air-fuel mixture from the burner a significant decrease in pressure.

The latter pressure drop results in, on the one hand, the suction entrainment of the hot gases which flow along the outer part of the air-fuel jets and, on the other hand, enlarge the air-fuel jets, which are sheathed by an annular peripheral air jet.

The annular peripherical air jet stabilizes and adjusts the length of the flame, entraining, at the same time, a certain amount of ambient air necessary for complete combustion. The speed of the jet is determined by the size of the exit slot, which can be adjusted properly by replacing a muff or sleeve in order to obtain a flame with a proper length and diameter.

The burner, according to the invention, comprises an outer body which has a cone core mounted at its front part, at the rear part of the outer body including a pressure chamber provided with means for supplying air under pressure and with circumferentially disposed apertures. The apertures communicate with a convergent chamber ending in an annular slot, which can be adjusted by replacing a muff or sleeve mounted at the front part of the cone core.

An injector is located in the middle and rear part of said burner and is formed with a central fuel-supply channel leading to an impact or impingement chamber, that has a plurality of apertures provided on its front wall. These apertures have their axes either parallel or inclined to the axis of the burner.

A rosette is located in the impact chamber, this rosette being connected to a profiled baffle, the injector being located in a mixing nozzle, which consists of a pressure chamber that leads through a slot to the pressure chamber of the outer body. The pressure chamber of the mixing nozzle leads to a mixing chamber through an annular slot, defined by the front part of the injector and by the inner wall of the mixing chamber, which is formed with two annular narrow diameter steps. The mixing chamber leads to an expansion chamber provided at the front part, with a rosette, which consists of a central obturator (flow-blocking member) and of a plurality of peripheral apertures. The mixing nozzle has a restrictive ring located at the front outer part and this ring is fixed in place by a cylinder formed on its outer part with inclined guide blades that are used for the flaring of the air jet.

BRIEF DESCRIPTION OF THE DRAWING

The invention will best be understood by reference to the accompanying drawing in which.

SPECIFIC DESCRIPTION

Figure 1:
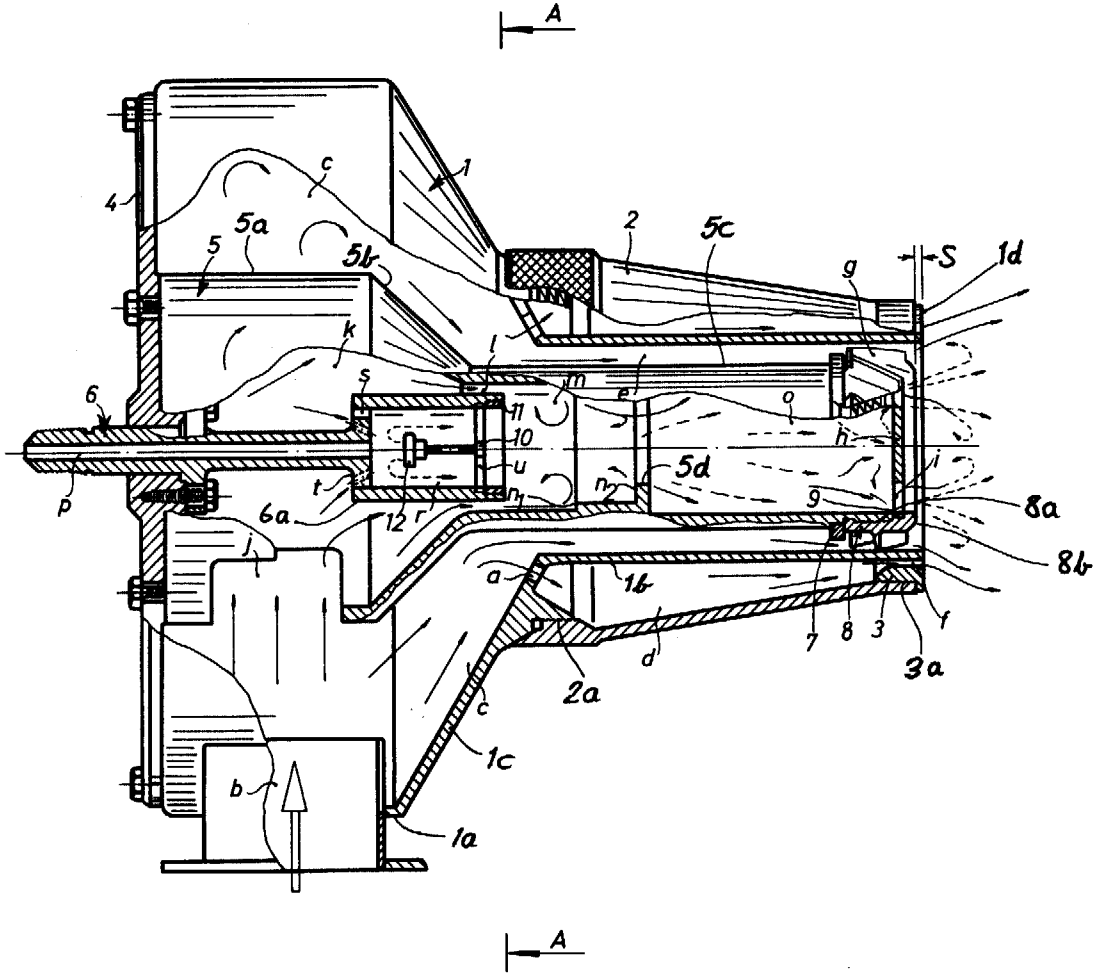
FIG. 1 is a partial section view through the burner.
Figure 2:
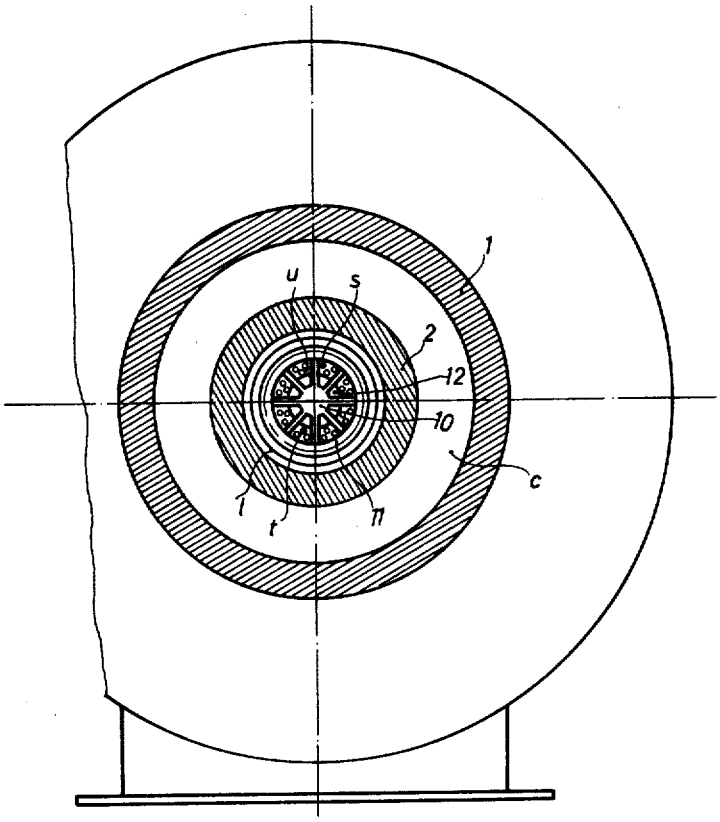
FIG. 2 is a cross-section taken along the line A—A in FIG. 1.
Figure 3:
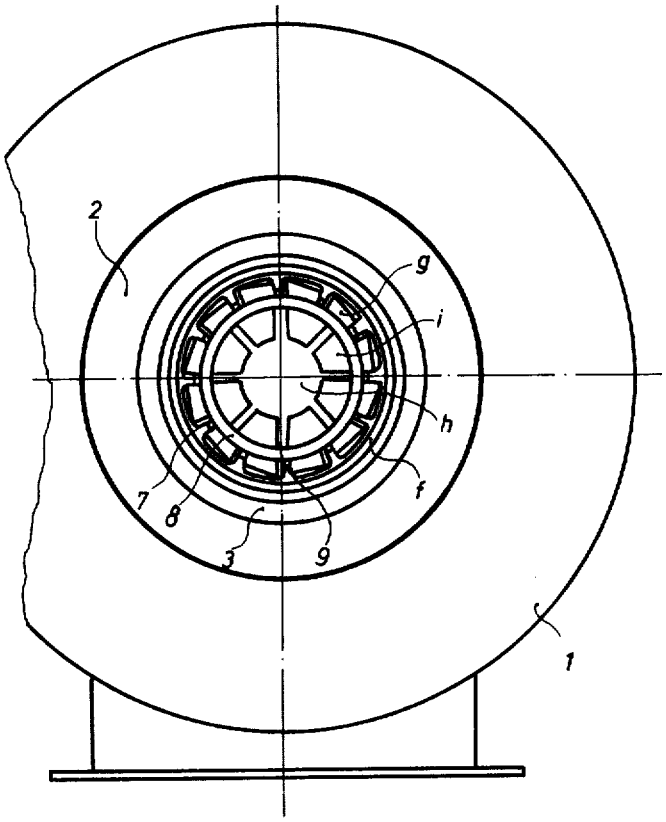
FIG. 3 is a view of the burner front part.
Figure 4:
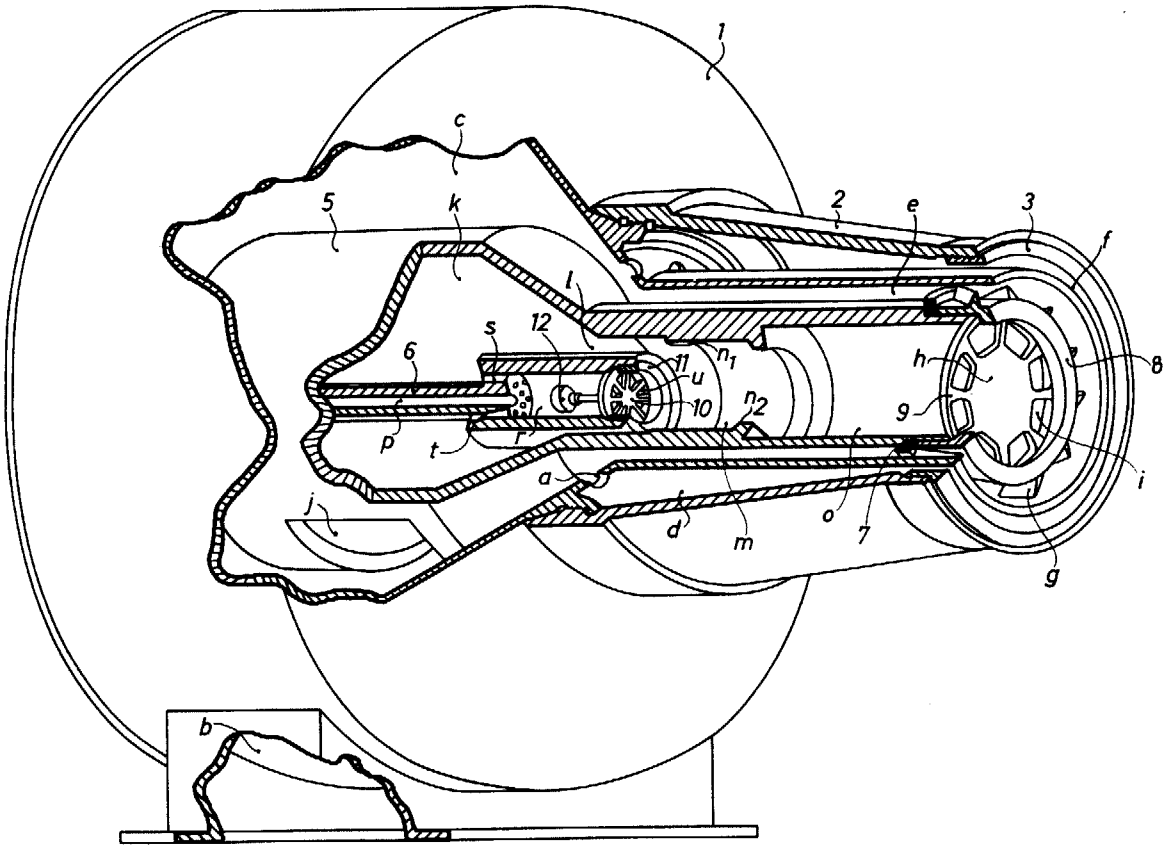
FIG. 4 is a partially sectioned perspective view.

The burner consists of an outer body 1, which has at its front part a cone 2 screwed at 2a thereon and carrying at its front part with a muff or sleeve 3 which is replaceable in the cone 2 and is threaded at 3a into the latter.

The outer body 1 consists of two cylindrical parts, 1a, 1b, with different diameters, connected by a cone portion 1c in which a plurality of gauged apertures *a* are circularly disposed.

The cylindrical portion 1a with the larger diameter is formed with a supply aperture *b* for the air under pressure which is disposed symmetrically with respect to the burner axis.

On the same portion 1a of the outer body 1 there is mounted an end flange 4, that is connected to a mixing nozzle 5 and to an injector 6.

Between the cylindrical portion 1a and the conical portion 1c of the outer body 1 and the cylindrical and conical portions 5a, 5b of the mixing nozzle 5, there is an annular pressure chamber *c* for air which, through the aperture *a*, communicates with a convergent chamber *d* defined by the cone 2 and the front cylindrical portion 1b of the outer body 1. The chamber *c* leads to an annular conduit *e* defined between the front cylindrical portion 1b of the outer body 1 and by the front portion 5c of the mixing nozzle 5.

The convergent chamber *d* terminates in a circular slot *f* defined between the muff or sleeve 3 and by the front end 1b of the outer body 1.

At the front portion 5c of the mixing nozzle 5 a restrictive ring 7 is mounted freely, secured by means of a turbulence nozzle 8, comprising an internally threaded cylinder 8a which is formed at its outer part with inclined guide blades *g*. Between the end of the mixing nozzle 5 and the turbulence nozzle 8, a rosette 9 is located. The rosette 9 has a central obturator *h* and a plurality of peripherical apertures *i*.

Between the end 1d of the burner and the front surface 8b of the turbulence nozzle 8 formed with guide blades 9, there is a convenient chosen distances.

The mixing nozzle 5 has an air supply slot *j*, located symmetrically with respect to the axis of the burner.

At the back part of the mixing nozzle 5 there is a pressure chamber *k*, that leads to a mixing chamber *m* through a slot *l* defined between the front part 6a of the injector 6 and by the part 5c of the nozzle 5. The chamber *m* is formed with two cylindrical constrictions or steps $n_1$ and $n_2$. The mixing chamber *m* thus communicates through a constriction 5d with an expansion chamber *o*.

There is a tap set at the back part of the injector 6. This can be connected to the fuel supply pipe and is provided with a central conduit *p*, which leads at the front part to an impact chamber *r*. The chamber *r* communicates with the pressure chamber *k* by means of the apertures *s*, circumferentially distributed and parallel to the burner axis, at the periphery of the impact chamber and by means of the apertures *t* with axes inclined toward the burner axis.

A rosette 10 is secured to the front part of the impact chamber *r*, by means of a threaded sleeve 11. The rosette 10, provided with radially and centrally disposed apertures *u*, is interlocked, by means of the profiled baffle 12, with two stages of different diameters.

The impingement baffle 12 is located at a convenient distance from the terminal surface of the apertures *s* and *t* and of the fuel channel *p*.

SPECIFIC EXAMPLE

The burner functions as follows:

The burner is intended to be used for the combustion of heavy liquid fuel, such as residue oils and the high viscosity tars resulted from the refining of the oil.

The fuel is centrally introduced through the channel *p* of the injector 6 at low pressure, between 1.8 and 3 kgf/cm$^2$.

At the outlet of the channel *p* the fuel jet is expanded down to a pressure limited by the atmospheric pressure and by the pressure of the injected air into the burner.

The necessary air for the pulverization of the fuel is introduced through the supply aperture *b* at a pressure that varies between 350 – 1200 mm $H_2O$, entering the pressure chamber *c* and through the slot *j* into the pressure chamber *k*, forming two main air circuits (represented in the FIG. 1 by the solid arrows):

The first air circuit starts from the pressure chamber *k* and enters the impact chamber *r* through the apertures *s* and *t* and the mixing chamber *m* through the annular slot *l*.

The second air circuit starts from the pressure chamber *c* and enters the annular channel *e* and the convergent chamber *d* through the apertures *a* which have dimensions limiting the air flow entering that chamber.

Within the impact chamber *r*, the fuel jet impinges upon the baffle 12, suffering a shock pulverization, the resulting drops hit again the air jets coming from the inclined apertures *t* in the first pulverization stage of the fuel drops.

The air and fuel mixture (represented in FIG. 1 by arrows with broken lines) resulting from the first pulverization stage passes between the exterior surface of the profiled baffle 12 and the air-film created by the air jets coming from the apertures *s* so that this film prevents the precipitation of the fuel drops on the walls of the chamber *r*.

The air-fuel mixture passes through the apertures *u* of the rosette 10, where the pulverization is carried out under the action of the vortices created by the rosette body and enters the mixing chamber *m*. At the same time, the annular air jet enters the chamber *m* through the slot *l* from the pressure chamber *k* of the first air circuit.

The interaction of the annular air jet that passes through the slot *l* and the central air-fuel jet, owing to the linear thresholds $n_1$ and $n_2$, produces a homogeneous air-fuel mixture. At the same time the fine pulverization is increased under the effect of the air vortices resulting from the thresholds $n_1$ and $n_2$.

A velocity increase of the air-fuel mixture takes place along the chamber *m* up to the entrance of the expansion chamber *o*, this further promoting pulverization.

Along the chamber *o* the air-fuel mixture suffers a continuous expansion. At the exit from the chamber it hits the central obturator or impingement baffle *h* where an impact of the central fuel particles takes place, obliging the air-fuel mixture to leave the chamber *o* through the peripheral apertures *i*.

The air-fuel mixture that leaves the chamber *o* through the apertures *i* as jets interacts with the annular air jet at the exterior end of the chamber, the air stream having a helicoidal movement caused by the guide blades *g* of the turbulence nozzle 8. It has an increased velocity determined by the constriction of the conduit *e* formed by ring 7.

The annular air jet with a helicoidal movement operates within another annular peripherical air jet, with an axial movement, which emerges from the slot *f*. Adjusted properly from the frontal end of the conical chamber *d* by replacing the muff 3, the two jets constitute the second main air circuit.

The first main air circuit that forms the air-fuel mixture inside the burner and that which leave the apertures *i* as jets interacts at its emergence from the burner with the second main air circuit which produces the annular air jet with helicoidal movement and the annular peripherical jet with an axial movement.

The air-fuel jets that leave the apertures *i* create in front of the obturator *h* at the exit from the burner a vortex zone which controls scattering to the interior of the air-fuel jets, increasing the pulverization of the mixture.

The air jet with helicoidal movement due to the centrifugal force determined by the tangential component of the helicoical movement, produces an expansion of the air jet, creating in the interior between this jet and the air-fuel jets a depression zone that determines the expansion of the air-fuel jets. The amount of hot air in the furnace increases the evaporation rate and activates the pulverization, producing ahead of the flame, an air-fuel mixture of a high degree of pulverization.

The axial component of the helicoidal movement, together with the annular peripherical air jet with an axial movement, guides and limits the scattering of the fuel drops, adjusting the flame front and the flame.

The air jets from the second main circuit drive the air mass from the exterior, which is necessary for complete combustion.

The present invention possesses the following advantages:

it allows the complete burning of the low-grade residue oils and tars, resulting from oil refining, with a minimum excess of air;

it uses a lower injection pressure for the fuel namely between 1.8 and 3 kgf/cm$^2$;

it allows the use of the fuel with impurities, eliminating the need for fine filtration before entering the burner, due to the large section of the admission conduit of the fuel into the burner, and to the other flow-cross-sections for the fuel;

it eliminates the possibility of the fuel coking on the heated surfaces of the burner, the adjusting of the flame being performed by an annular air jet, and the space between the flame front and the frontal surface of the burner being cooled by the air jets;

it uses low pressure air (up to 1200 mm $H_2O$) of the same level both for the fuel pulverization and for the flame adjusting, permitting the use of a single blower;

it allows the use of the residue oils and tars, both in a preheated state (up to 90° C) and at the ambient temperature without preheating of the air;

it has a long life, because the frontal part of the burner is protected against overheating, due to the peripheral air jets;

it allows the complete burning of the liquid fuel with a small consumption of energy due to the fuel injection and the admission of the air into the burner at a lower pressure, the air quantity necessary for the burning being taken by ejection;

it allows safe operation, avoiding flame interruption, due to the elimination of the injection nozzles with small flowcross section that are easily clogged;

it permits stable operation due to an annular peripherical air jet, with time constant features; and it allows flame adjustment according to requirements modifying the features of the annular peripherical air jet which plays the part of a stabilizer.

We claim:

1. A method of burning a high-viscosity low-grade liquid fuel comprising the steps of:

a. directing a stream of the liquid fuel against a first impingement baffle in an impact chamber to produce rebounding fuel particles;

b. mixing air with said particles within said chamber to form a fuel-air mixture;

c. passing said fuel-air mixture around said impingement baffle and along an internal wall of said chamber while preventing deposition of fuel thereon by conducting an annular stream of air along said wall to discharge the fuel-air mixture axially from said chamber;

d. passing said fuel-air mixture and a further annular stream of air axially away from said chamber while intercepting same in succession with a pair of axially spaced inwardly directed annular steps thereby turbulently mixing said further air and said fuel-air mixture to produce a high velocity fuel-air flow;

e. introducing said fuel-air flow axially into an expansion chamber and directing the same against a second impingement baffle to further pulverize the fuel in said fuel-air flow, and discharge the same axially from said expansion chamber;

f. directing a helically flowing stream of air axially beyond the expansion chamber and directly around the fuel-air flow discharged therefrom to mix said helically flowing stream with said fuel-air flow; and g. controlling the flame front and frame formed upon ignition of the mixture of fuel and air resulting from step (f) by diverting still another axial air stream outwardly around said helically flowing stream.

2. The method defined in claim 1 wherein, in step (b), air is mixed with said particles by inducing jets of air into said impact chamber at an inclination to the axis thereof in the direction of said first impingement baffle to interact with said rebounding fuel particles.

3. The method defined in claim 2 wherein the fuel is introduced at a pressure between 1.8 and 3 kgf/cm$^2$ in step (a).

4. The method defined in claim 3 wherein all of said streams of air are introduced at a pressure ranging from atmospheric pressure up to 1200 mm $H_2O$.

5. A burner for the combustion of a high-viscosity low-grade fuel, comrising:

a housing having a cylindrical rear portion of relatively large diameter and cylindrical front portion of relatively small diameter;

a cone surrounding said front portion and defining a first air-flow passage converging forwardly toward the end of said front portion and opening at said end axially;

means for introducing air into said rear portion of said housing, said housing being formed with apertures communicating between the interior of said portions and said passage for admitting air thereto;

a mixing nozzle received in said housing and formed with a cylindrical rearward portion of relatively large diameter provided with an air opening and a forward portion of relatively small diameter extending forwardly of said rearward portion of said mixing chamber and defining within said front portion of said housing, a second air-flow passage opening axially at said end of said housing;

guide means at the forward end of said second air-flow passage for deflecting air emerging therefrom in a helically rotating stream coaxial with but inwardly of an annular stream of air emerging from said first air-flow passage, said forward portion of said mixing chamber being provided in succession in the forward direction with a pair of axially spaced inwardly projecting steps and an expansion chamber, said expansion chamber opening at said end of said housing to discharge a fuel-air flow from said mixing chamber within the heilcally rotating stream;

an impact chamber coaxial with said mixing chamber and disposed therein rearwardly of said steps to define with said forward portion of said mixing chamber an annular passage for a further air stream flowing axially along the interior of said forward portion of said mixing chamber;

a first impingement baffle in said impact chamber, said impact chamber being provided with means for directing a stream of said fuel against said first impingement baffle to form particles of fuel, and with apertures communicating with the interior of said rearward portion of said housing to admit air forming a fuel-air mixture with said articles, said impact chamber opening axially into said forward portion of said mixing chamber for discharging said fuel-air mixture into said further air stream; and a second impingement baffle disposed at a forward end of said expansion chamber for further pulverization of fuel contained in said fuel-air mixture.

6. A burner defined in claim 5 wherein said impact chamber is formed with apertures for directing jets of air inwardly and forwardly to interact with particles rebounding from said first impingement baffle, and with further apertures for conducting a flow of air axially along an internal wall of said impact chamber around said first impingement baffle to prevent deposit of fuel upon said wall.

7. The burner defined in claim 6 wherein said first passage is formed at said end with a replaceable sleeve defining an annular slot with said forward portion of said housing.

8. The burner defined in claim 7 wherein said forward portion of said mixing chamber is provided at said end with a nozzle member threaded onto said forward portion of said mixing chamber and carrying guide vanes for inducing helical movement of said helical air stream.

9. The burner defined in claim 8 wherein said impact chamber is open axially toward said end and is provided with a first rosette having a central member and a plurality of circularly distributed apertures, said central member carrying said first impingement baffle, said second impingement baffle being formed as a second rosette in said expansion chamber proximal to said end, said forward portion of said mixing chamber being provided externally with a constriction ring forming a constriction in said second passage ahead of said vanes.

10. The burner defined in claim 9 wherein said cone is threaded onto and removable from said housing.

* * * * *